United States Patent [19]

Wells

[11] 4,039,101

[45] Aug. 2, 1977

[54] CLEAN COVER FOR EASY-OPEN CONTAINER TAB

[76] Inventor: Robert A. Wells, 4450 Harris Trail NW., Atlanta, Ga. 30327

[21] Appl. No.: 760,380

[22] Filed: Jan. 18, 1977

[51] Int. Cl.[2] ..... B65D 41/32

[52] U.S. Cl. ..... 220/269; 220/258

[58] Field of Search ..... 220/256, 258, 266–277; 222/541

[56] References Cited

U.S. PATENT DOCUMENTS

| | | | |
|---|---|---|---|
| 3,362,572 | 1/1968 | Herbst | 220/270 |
| 3,934,750 | 1/1976 | Telly | 220/268 X |

*Primary Examiner*—George T. Hall

[57] ABSTRACT

A cover that overlies the opening tab on an easy open to shield the opening tab and underlying elements from accumulations of dirt or other foreign substances. The clean cover is mounted so as to be nondetachable from the opening tab or other structure of the container, so that the clean cover cannot become a separate item of litter. The clean cover is flexible and can be depressed or otherwise sufficiently manipulated with the tab as necessary to open the container, and may slide or otherwise move with the tab as part of the normal container-opening function. The clean cover may be physically attached to the opening tab, or may alternatively be attached to the container end panel on which the tab is mounted.

10 Claims, 13 Drawing Figures

CLEAN COVER FOR EASY-OPEN CONTAINER TAB

This invention relates in general to containers and in particular to easy-opening containers.

There have been numerous efforts to design and perfect a so-called "ecology" beverage container, that is, a container having the easy-open characteristics associated with pop-top beverage containers without producing any tear tab or other structure which becomes detached from the container during the opening procedure. Some types of ecology containers propose to utilize an opening tab which is mounted on an end panel of the container so as to overly at least a portion of an openable member formed in the end panel by a selectably separable region. While opening tabs of such proposed ecology container ends may have various configurations and modes of operation, such opening tabs typically are manually operable in some manner to separate an underlying openable member from the remainder of the end panel, so that the separated openable member can be displaced to expose an opening through which the contents of the container can be dispensed. Example of several proposed ecology ends are found in U.S. Pat. Nos. 3,934,750; 3,236,409; and in pending applications Ser. No. 580,624 filed May 27, 1975; and Ser. No. 639,167 filed Dec. 9, 1975.

Since the foregoing and possibly other ecology container ends have an opening tab positioned over structure which becomes separated from the end panel to form a beverage-dispensing opening, acceptance of such ends appears to be hindered by concern that dirt or other foreign matter may accumulate beneath the opening tab to render the opened container unsanitary. While such concern may be unfounded, the psychological impact of such perceived sanitary considerations may nonetheless deter some persons from purchasing canned beverages that are packaged with such ecology ends.

Accordingly, it is an object of the present invention to provide an improved easy-opening end structure for beverage containers or the like.

It is another object of the present invention to provide a clean cover for easy-open container ends.

It is still another object of the present invention to provide an ecology easy-open container and which resists the possible accumulation of dirt in the opening region.

Other objects and attendant advantages of the present invention will become apparent from the following description of the invention and of the disclosed embodiments thereof.

Stated in general terms, the present invention provides a cover structure which locally overlies the container opening tab as well as underlying structure of the container end wall, so as to protect the opening tab and underlying structure from exposure to foreign matter. Stated somewhat more specifically, the present invention provides opening tab structure in which the opening tab is provided with a cover that is movable with the tab so as not to inhibit the normal opening functions of the tab, and that does not become detached from the container during the normal container-opening operation.

The present invention may be better understood by reference to the disclosed embodiments thereof as shown in the drawings, in which.

Figure 1:
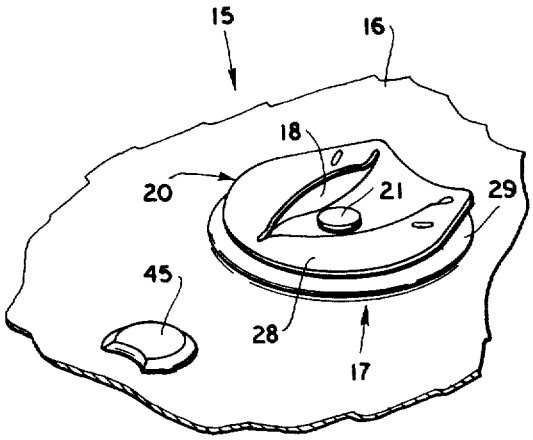
FIG. 1 shows a fragmentary pictorial view of a container end wall equipped with representative easy-opening structure from which the present clean cover is omitted for illustrative purposes.
Figure 2:
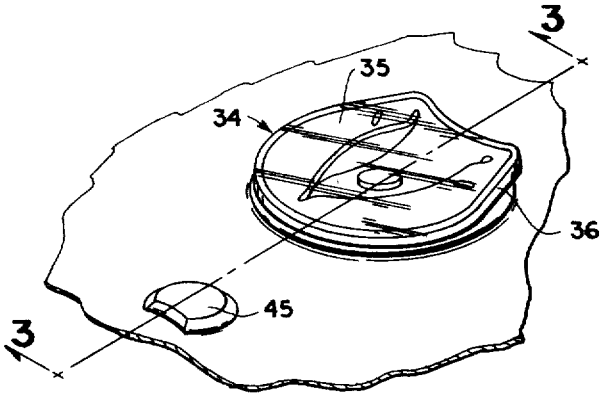
FIG. 2 is another fragmentary pictorial view showing the end structure of FIG. 1 provided with a clean cover according to a disclosed embodiment of the present invention.
Figure 3:
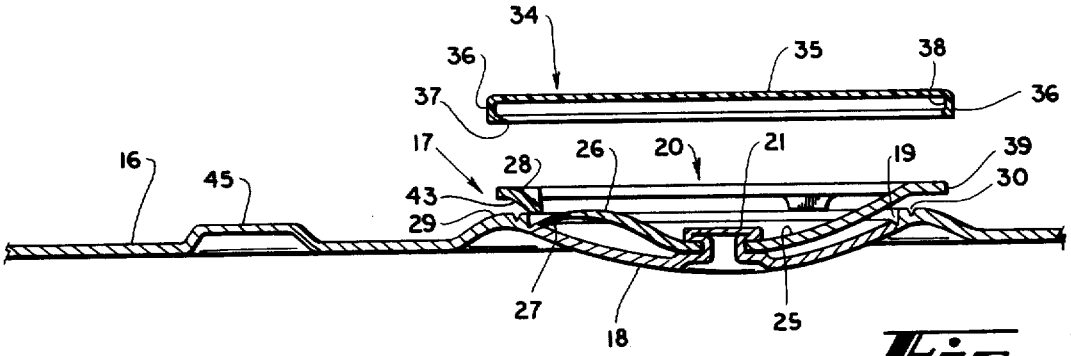
FIG. 3 is a section view taken along line 3—3 of FIG. 2, showing the cover in exploded relation to an opening tab.

Turning to FIGS. 1 and 3, 15 designates a fragmentary portion of an end panel 16 intended for attachment to a beverage container or the like, and equipped with easy-opening structure indicated generally at 17. The easy-opening structure 17, as best illustrated in FIG. 3, is characterized by an openable member 18 defined in the panel 16 by a continuous selectably separable region 19, and by an opening tab 20 which is secured to the openable member by any suitable means such as a rivet 21 or the like. The separable region 19 may be provided by various manufacturing techniques, as is known to those skilled in the art, and may be either a nonrepaired score formed in the end panel or a repaired region. The openable member 18, which is defined in the panel 16 by the separable region 19, is dished inwardly from the separable region in the embodiment depicted in FIGS. 1-5, although an openable member of flat or other nonconcave configuration may alternatively be provided.

The opening tab 20 includes a central finger 25 which conforms to the configuration of the openable member 18 at least at the point of attachment to the openable member, illustrated by the rivet 21 in FIG. 3, and which includes a portion 26 extending forwardly of the rivet 21 and terminating at a pointed end 27 in close proximity to a location adjacent the separable region 19. The pointed region 27 may be useful in initiating separation of the separable region 19, as explained below. The opening tab 20 also includes a flange 28 which is integrally connected to the finger 25 and which overlies most or all of the annular rim 29 surrounding the separable region 19 in the end panel 16. An annular score line 30 may be formed on the rim 29 in exterior surrounding relation to the separable region 19, as discussed in the above mentioned pending application Ser. No. 639,167.

The easy-opening structure 17 is provided with a clean cover 34 which, in the embodiment of FIGS. 1-5, is a one-piece preformed cap made of any suitable resilient material such as PVC or the like. The cap 34 has a substantially flat top surface 35, an annular rim 36 which joins and extends downwardly from the top surface 35, and an annular lip 37 which is at the lower end of the rim 36, in spaced apart relation to the top surface 35, and which extends radially inwardly a short distance from the annular rim. The present embodiment of the clean cover 34 preferably is of sufficient thickness and structural strength to maintain the predetermined shape as depicted and described, although the clean cover should be sufficiently flexible so as to not impede or inhibit opening of the easy-opening structure 17 as described below.

The top surface 35 of the clean cover 34 preferably has an overall plan-view configuration which at least covers the corresponding configuration of the opening tab 20, as best seen in FIG. 2. The gap 38 defined on the interior of the annular rim 36 by the annular lip 37 is preferably just large enough to accommodate the thickness 39 of the flange 28 on the opening tab 20. The clean cover 34 may be attached to the opening tab 20 simply by snapping the annular lip 37 over the flange 28 of the opening tab, so that the annular lip fits under the flange of the opening tab to retain the sanitary cover in place on the opening tab, as best shown in FIGS. 4 and 5.

Figure 4:
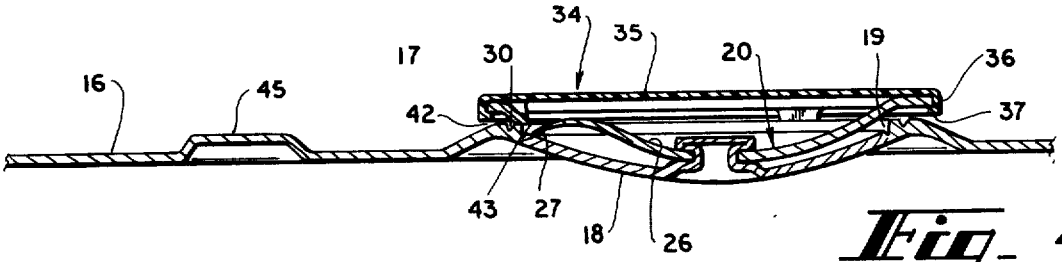
FIG. 4 is another vertical section view taken along line 3—3 of FIG. 2, showing the cover in assembly with the opening tab.
Figure 5:
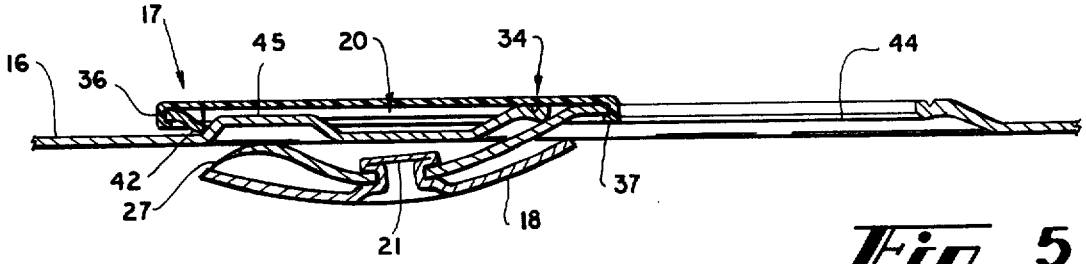
FIG. 5 is a vertical section view taken along line 3—3 of FIG. 2, showing the end panel in fully-opened configuration.

It is apparent from FIGS. 2 and 4 that the clean cover 34 completely overlies the opening tab 20 as well as the openable member 18, the space between the opening tab and the openable member, and the separable region 19. The clean cover thus eliminates or materially reduces the chance that dirt or other foreign matter can accumulate in the vicinity of the separable region 19, or at other locations beneath the opening tab 20 or on the openable member 18.

Since the openable member 18, in the embodiment of FIGS 1-5, is opened by manually pressing downwardly on the opening tab 20 so as to transmit force to the panel 16 on or in the vicinity of the separable region 19, the annular lip 37 of the sanitary cover should be dimensioned to leave sufficient clearance 42 (FIG. 4) between the underside of that lip and the confronting surface of the panel 16 so that opening force applied downwardly against the opening tab is not absorbed by engagement of the annular lip with the panel. One specific example of tab contact during opening is shown by engagement of the opening tab boss 43 (FIG. 4) with the panel surface between the annular score line 30 and the separable region 19. The pointed end 27, if provided in a particular embodiment, will be forced downwardly by the downwardly-applied opening force to initiate opening of the separable region 19, and so it will be appreciated that the top surface 35 of the sanitary cover 34 should be sufficiently resilient to transmit the manual downwardly-directed force to the opening tab portion 26 and the flange 28 of the opening tab.

Once the separable region 19 has become completely separated by downwardly applied force against the covered opening tab 20, the flange 28 of the opening tab contacts the panel 16 to prevent the opening tab from entering the opening 44 which now exists in the panel 16. The opening tab can now be slidably displaced along the outside of the panel 16 to the position shown in FIG. 5, and it can be seen that the tab portion 26 and the now-separated openable member 18 attached thereto are thereby slidably displaced along the underside of the panel to expose the opening 44. A locking member 45 can be provided extending upwardly in the top surface of the panel 16, in spaced apart relation to the unopened position of the opening tab 20, so that the boss 43 of the opening tab can engage the locking member to retain the opening tab and connected openable member 18 in the fully-open position as seen in FIG. 5.

Figure 6:
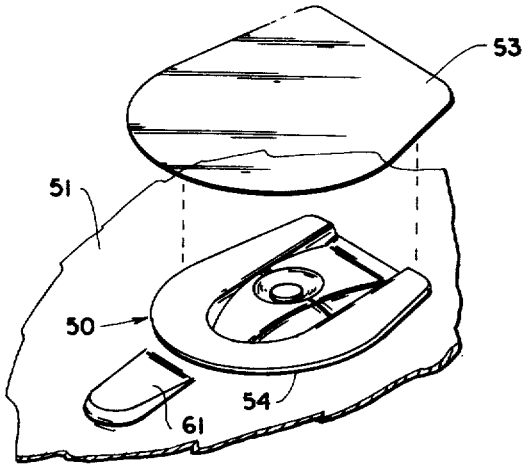
FIG. 6 is a fragmentary exploded pictorial view showing another disclosed embodiment of the present invention.
Figure 7:
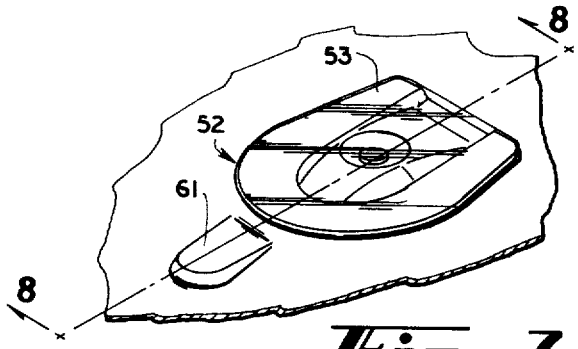
FIG. 7 is a fragmentary pictorial view showing the embodiment of FIG. 6 in assembled configuration.
Figure 8:
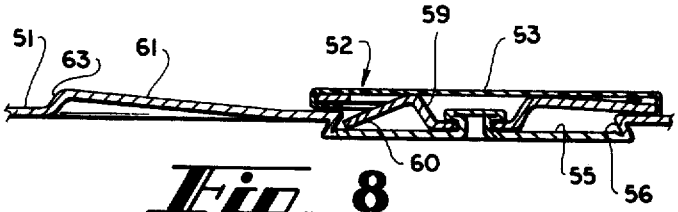
FIG. 8 is a vertical section view taken along line 8—8 of FIG. 7.

Turning to the embodiments shown in FIGS. 6-8, the easy-opening structure 50 of the container end panel 51 is equipped with a clean cover 52 formed by a thin layer of plastic film 53 which is shrink-wrapped onto the opening tab 54. The opening tab 54 is attached to an openable member 55, best seen in FIG. 8, which is substantially flat and which is integrally formed and defined in the end panel 51 by the selectably separable region 56 which slightly underhangs the remainder of the end panel. The film 53 is preferably configured to completely cover the opening tab 54 when shrink-fitted to the opening tab as shown in FIG. 7. Details of shrink-wrapping techniques are known to those skilled in the art and need not be repeated herein.

Opening of the easy-open structure 50 is accomplished by applying a downward force against the covered opening tab 54, so that the force is transmitted through the clean cover 52 and onto the finger portion 59 of the opening tab. The film 53 must be sufficiently resilient to give under applied force, so that force is transmitted to a location in the vicinity of the separable region 56 by way of the free end 60 of the finger portion 59. The separable region thus becomes fractured, allowing the opening tab 54 and the attached openable member 55 to be slidably displaced away from the opening which remains in the panel 51. A locking ramp 61 may be formed in the panel in front of the opening tab 54, as best seen in FIG. 8, so that the forward edge of the opening tab rides over the locking ramp to be received and engaged behind the relatively steep backside 63 of the ramp, thereby retaining the opening tab and attached openable member in fully-open position.

Although the shrink-film clean cover 52 shown in the embodiment of FIGS. 6-8 is applied to an easy-opening structure somewhat different from the corresponding structure shown in FIGS. 1-5, it is considered to be within the scope of the present invention to apply a shrink-wrapped clean cover to the opening tabs of easy-open structure other than as specifically shown in FIGS. 6-8.

Figure 9:
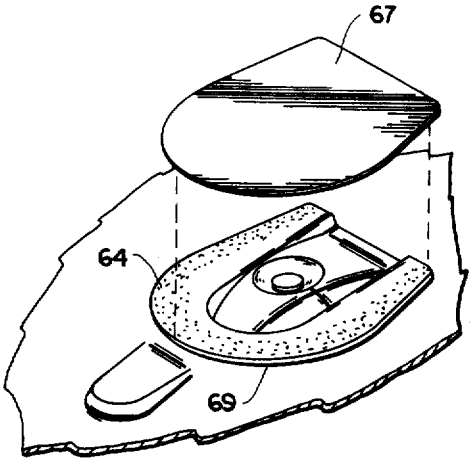
FIG. 9 is a fragmentary exploded pictorial view showing still another disclosed embodiment of the present invention.
Figure 10:
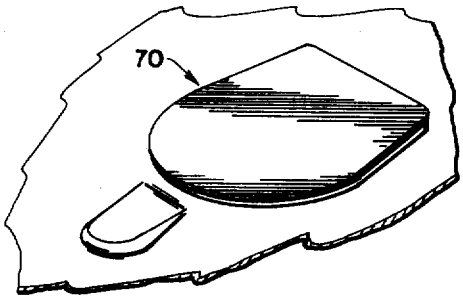
FIG. 10 is a fragmentary pictorial view showing the embodiment of FIG. 9 in assembled configuration.

The embodiment depicted in FIGS. 9 and 10 differs from the embodiment of FIGS. 6-8 in that the layer of plastic film 67 is adhesively attached to the flange 68 of the opening tab 69 to provide the clean cover 70 shown in FIG. 10, in lieu of the shrink-wrap clean cover of the preceding embodiment. It should be understood that adhesive securement of a clean cover to an underlying opening tab is not confined to the specific construction of opening tab shown in FIGS. 9 and 10.

Figure 11:
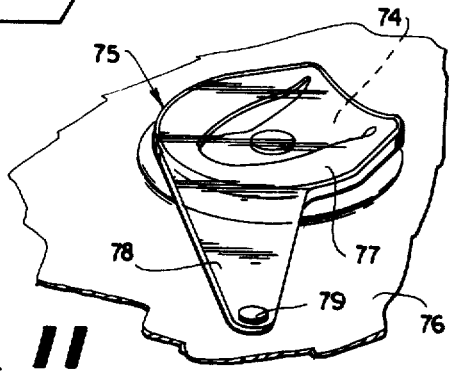
FIG. 11 is a fragmentary pictorial view of yet another disclosed embodiment of the present invention.
Figure 12:
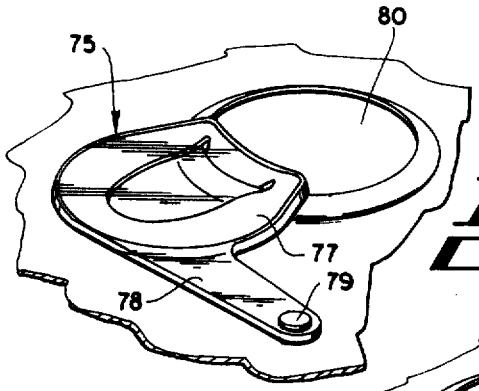
FIG. 12 is a fragmentary pictorial view of the FIG. 11 embodiment, in fully-open configuration.
Figure 13:
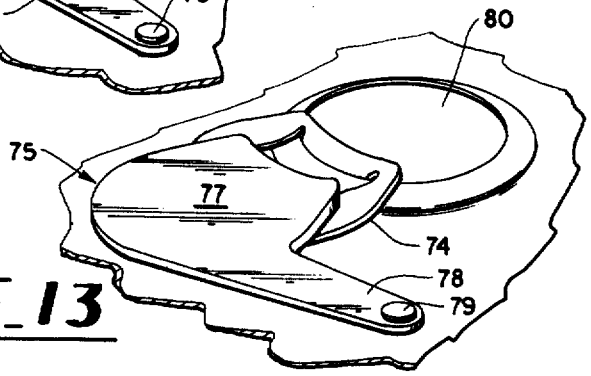
FIG. 13 is a fragmentary pictorial view of the embodiment shown in FIGS. 11 and 12, with the cover shown partially displaced from the tab of the opened container.

Turning to FIGS. 11-13, the opening tab 74 is covered by a clean cover 75 which is nondetachably retained on the end panel 76 by being attached to the end panel, rather than by being attached to the opening tab itself as in the previously-described embodiments of the present invention. The clean cover 75 has a main portion 77 which covers the opening tab 74, and also has an arm portion 78 which is preferably formed integrally with the main portion and which extends along the end panel 76 to terminate at a location which lies beyond the opening tab and the underlying openable member (not shown). The arm portion 78 is pivotably secured to the end panel 76 by any suitable technique, such as by the rivet 79 formed in the end panel and extending through a mating opening near the outer end of the arm portion. The clean cover 75 is preferably formed of PVC or another suitable plastic material which, like the clean cover 34 described above, has sufficient structural strength to maintain a predetermined shape, while being sufficiently flexible to give in response to manual force applied downwardly onto the main portion 77 to press against the underlying opening tab 74.

The clean cover 75 is normally positioned in overlying relation with the easy open structure as shown in FIG. 11, so that the opening tab 74 and underlying areas are protected against contamination by dirt and other foreign matter. The container is opened by pressing downwardly on the main portion 77 of the clean cover to break the underlying selectably separable region (not shown), in substantially the same manner as described above with respect to the preceding embodiments, after which the separated opening tab 74 may be slidably displaced along the outside of the end panel 76. The clean cover 75 can be pivoted about the rivet 79 at the same time, so that the opening tab 74 and the clean cover 75 arrive at the fully-open position shown in FIG. 12. The opening 80 in the end panel 76 is now exposed.

FIG. 13 shows the clean cover 75 as displaced a distance beyond the maximum sliding extent of the opening tab 74, for illustrative purposes. It will be apparent that the clean cover 75 can be pivoted away from the opening tab 74 before the container is opened, if desired, although such pre-opening displacement of the sanitary cover would not normally be accomplished.

It can be seen from the foregoing embodiments that a relatively inexpensive clean cover is provided which effectively protects the opening tab and underlying areas from contamination. It will also be evident that alternative constructions of clean covers can be provided according to the teachings of the present invention. For example, the disclosed preformed sanitary cover embodiments of predetermined shape can be replaced by flowing a quantity of plastic material, in a liquid or semiliquid state, onto the opening tab so as to completely cover the opening tab. Such plastic material must be curable to a resilient solid state, so as to provide a clean cover which thereafter protects the tab from contamination. The cured plastic material should, of course, be sufficiently resilient to transmit downwardly-directed opening force to the opening tab.

The present clean cover also provides a safety factor for the person who opens a container so equipped, since the clean cover prevents the user from contacting any sharp edges of the separable region upon opening.

Still another benefit of a container equipped with a clean cover according to the present invention is that the clean cover, in conjunction with opening tab structure which remains attached to the end panel, can be reclosed to protect the unused portion of contents in the container.

It will be understood that the foregoing relates only to preferred embodiments of the present invention, and that numerous changes and modifications may be made therein without departing from the spirit and the scope of the invention as defined in the following claims.

I claim:

1. An easy opening end member for a container, comprising:

a panel having an openable member defined therein by a selectably separable region;

an opening tab member secured to said openable member and having means which overlies at least a portion of said separable region; and means disposed on said opening tab member and covering substantially all of said opening tab member, so that said opening tab member as well as the portions of said panel beneath said opening tab member are protected from exposure to foreign matter.

2. Apparatus as in claim 1, wherein said cover means is sufficiently flexible to transmit manually applied force to said underlying opening tab member.

3. Apparatus as in claim 1, wherein said cover means is secured to said opening tab member for displacement with the opening tab member along said panel after said separable region becomes separated.

4. Apparatus as in claim 1, wherein cover means comprises a shrink-wrap film secured to said opening tab member.

5. Apparatus as in claim 1, wherein said cover means comprises a cap of predetermined configuration, said cap having resilient means operative to retainingly engage said opening tab member.

6. Apparatus as in claim 1, wherein:

said cover means has a first portion which closely overlies and covers said opening tab member, and a second portion which overlies said panel at a location thereon in spaced apart relation to said openable member; and means attaching said second portion of said cover means to said panel.

7. Apparatus as in claim 6, wherein said attaching means is operative to allow said cover means to be displaced along said panel to a position of nonalignment with the opening which is formed in said panel by separating said selectably separable region.

8. Apparatus as in claim 1, wherein said cover means is adhesively attached to said opening tab member.

9. Apparatus as in claim 1, further comprising:

means operatively associated with said openable member to prevent withdrawing said openable member through the opening which is formed in said panel by separating said selectably separable region; and means operatively associated with said opening tab means to support said opening tab means for sliding displacement along said panel when said separable region become separated.

10. An easy opening panel member for a container, comprising:

a panel having an openable member defined therein by a selectably separable region;

an opening tab associated with said openable member;

means closely overlying and covering said opening tab to protect the opening tab from exposure to foreign matter; and means retaining said overlying means in nondetachable relation with said panel so that said overlying means does not become detached from said panel when said selectably separable region becomes separated.

* * * * *